US008033798B2

(12) United States Patent
Suh et al.

(10) Patent No.: US 8,033,798 B2
(45) Date of Patent: Oct. 11, 2011

(54) COMPRESSOR VIBRATION DAMPER

(75) Inventors: Jeong Hwan Suh, Seoul (KR); Seung Yup Kim, Suwon-si (KR); Dong Koo Shin, Anyang-si (KR)

(73) Assignee: LG Electronics Inc., Seoul (KR)

( * ) Notice: Subject to any disclaimer, the term of this patent is extended or adjusted under 35 U.S.C. 154(b) by 946 days.

(21) Appl. No.: 11/647,557

(22) Filed: Dec. 29, 2006

(65) Prior Publication Data

US 2007/0177994 A1 Aug. 2, 2007

(30) Foreign Application Priority Data

Dec. 29, 2005 (KR) ..... 10-2005-0133379

(51) Int. Cl.
*F04B 39/06* (2006.01)

(52) U.S. Cl. ..... 417/363; 248/615; 267/140.4

(58) Field of Classification Search ..... 417/363, 417/902; 248/560, 638, 615, 634; 267/136, 267/140, 140.4, 141, 141.1, 152, 153
See application file for complete search history.

(56) References Cited

U.S. PATENT DOCUMENTS

| | | | | |
|---|---|---|---|---|
| 2,262,442 | A * | 11/1941 | Anderson | 193/35 B |
| 4,161,812 | A * | 7/1979 | Litch, III | 29/446 |
| 5,221,192 | A * | 6/1993 | Heflin et al. | 417/363 |
| 5,775,120 | A | 7/1998 | Inazuka et al. | |
| 5,775,123 | A | 7/1998 | Wakayama et al. | |
| 5,788,207 | A * | 8/1998 | Bunker | 248/634 |
| 6,182,460 | B1 | 2/2001 | Hernandez et al. | |
| 6,287,099 | B1 | 9/2001 | Chang, II et al. | |
| 6,354,558 | B1 * | 3/2002 | Li | 248/615 |
| 6,374,492 | B1 | 4/2002 | Myung et al. | |
| 6,412,298 | B2 | 7/2002 | Kang et al. | |
| 6,505,806 | B1 * | 1/2003 | Glaesener | 248/638 |
| 6,557,816 | B2 * | 5/2003 | Yoshida | 248/674 |
| 6,588,228 | B2 | 7/2003 | Choi | |
| 6,659,735 | B2 | 12/2003 | Kim | |
| 6,685,441 | B2 | 2/2004 | Nam | |
| 6,695,600 | B2 | 2/2004 | Koo et al. | |
| 6,772,601 | B1 | 8/2004 | Davis et al. | |
| 6,779,988 | B2 * | 8/2004 | Chen | 417/363 |
| 6,868,681 | B2 | 3/2005 | Woo et al. | |
| 6,912,865 | B2 * | 7/2005 | Seo et al. | 62/295 |
| 6,955,064 | B2 | 10/2005 | Lee et al. | |
| 6,962,058 | B2 | 11/2005 | Kim et al. | |
| 7,032,404 | B2 | 4/2006 | Kim et al. | |

(Continued)

FOREIGN PATENT DOCUMENTS

| | | |
|---|---|---|
| CN | 2646188 | 10/2004 |

(Continued)

OTHER PUBLICATIONS

Chinese Office Action dated Feb. 29, 2008. Chinese Office Action dated Aug. 8, 2008.

*Primary Examiner* — Charles Freay
*Assistant Examiner* — Patrick Hamo
(74) *Attorney, Agent, or Firm* — KED & Associates LLP

(57) ABSTRACT

A vibration damper includes a first damping member coupled to a compressor, a second damping member coupled to the first damping member, and a dispersion member between the first and second damping members to disperse torsional vibration forces from the compressor. The dispersion member may also serve to disperse axial and torsional vibration forces received from the compressor through the first damping member.

4 Claims, 9 Drawing Sheets

U.S. PATENT DOCUMENTS

| | | | |
|---|---|---|---|
| 7,036,331 | B2 | 5/2006 | Kim |
| 7,055,338 | B2 | 6/2006 | Ergarac et al. |
| 7,082,776 | B2 | 8/2006 | Shin |
| 7,114,345 | B2 | 10/2006 | Kim et al. |
| 7,121,106 | B2 | 10/2006 | Jung et al. |

FOREIGN PATENT DOCUMENTS

| | | |
|---|---|---|
| DE | 19930635 | 1/2001 |
| JP | 05-010263 | 1/1993 |
| JP | 11093835 | 4/1999 |

* cited by examiner

COMPRESSOR VIBRATION DAMPER

BACKGROUND

1. Field

One or more embodiments described herein relate to dampening vibration in a mechanical device.

2. Background

Compressors are used in various applications to compress gas or liquid. Examples of compressors include reciprocating compressors, scroll compressors, vane compressors, and centrifugal compressors. Scroll compressors are often used in refrigerators and air conditioners. In these or other compressors, or indeed in other types of mechanical devices, internal vibrations are generated which tend to degrade performance.

BRIEF DESCRIPTION OF THE DRAWINGS

The embodiments will be described in detail with reference to the following drawings in which like reference numerals refer to like elements wherein.

DETAILED DESCRIPTION

Figure 1:
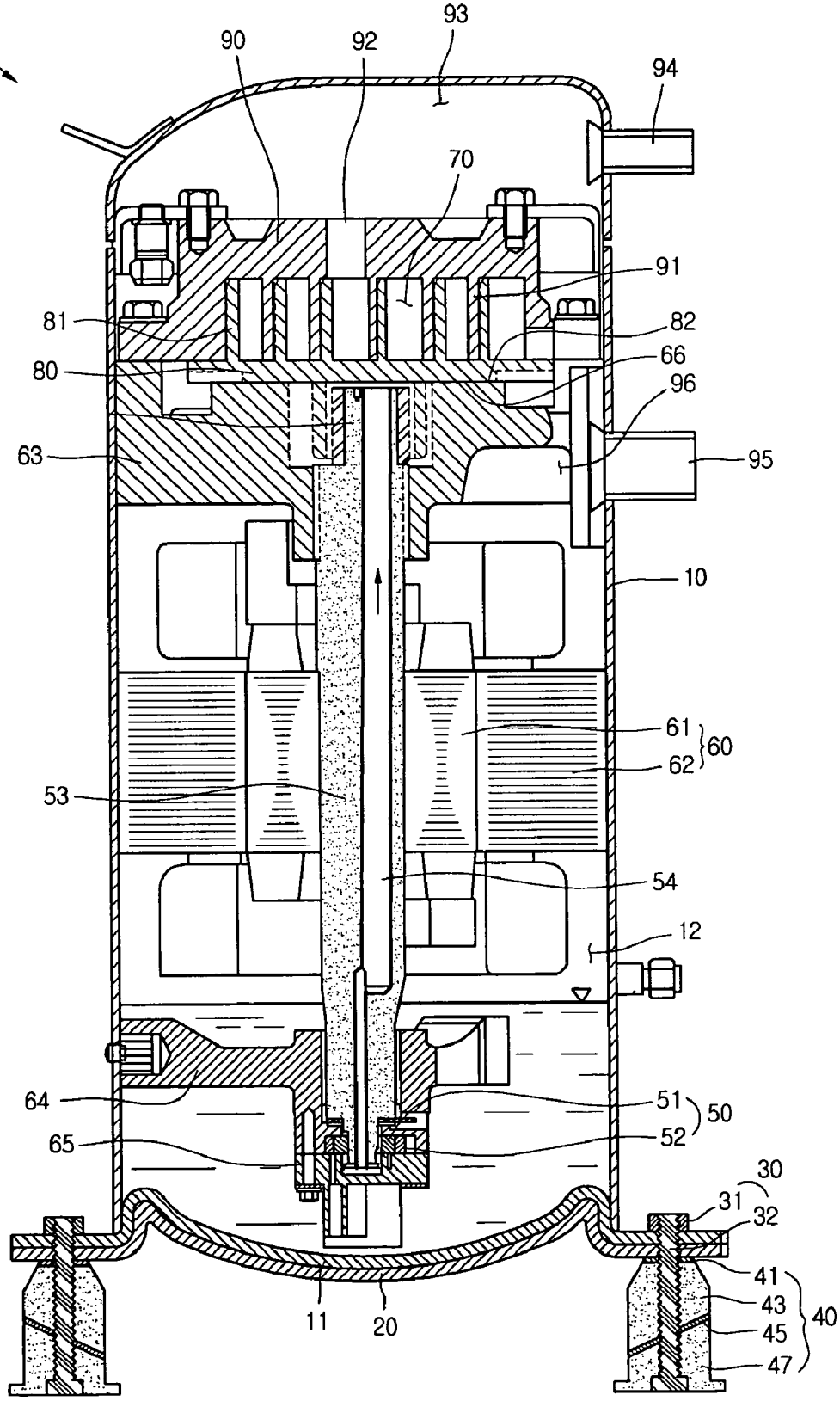
FIG. 1 is a diagram showing a cross-sectional view of one embodiment of a scroll compressor that includes a vibration damper.

Scroll compressors may be categorized as high-pressure compressors or low-pressure compressors. In a low-pressure compressor, intake gas is filled in a casing, while in a high-pressure compressor discharge gas is filled in the casing.

One type of low-pressure scroll compressor includes a driving motor, a driving portion, an upper frame, and an intake conduit. The driving motor is formed from a rotor and a stator. The driving portion is rotated by the driving motor and includes a driving shaft having an oil-feeding passageway. The upper frame is inserted in an upper portion of the driving shaft and fluid enters through the intake conduit.

The scroll compressor may also include a scroll compression portion and a discharge conduit. The scroll compression portion includes an orbiting scroll and a fixed scroll. The orbiting scroll is formed on an upper portion of the upper frame and operates to compress a refrigerant drawn in through the intake conduit. The fixed scroll meshes with the orbiting scroll and is fixed on the upper portion of the upper frame. The refrigerant compressed in the fixed scroll is discharged through the discharge conduit.

The scroll compressor further includes an oil reservoir is formed in an inner lower portion thereof. Oil in the oil reservoir is pumped upward by an oil pump. Further, a base plate is formed in a lower portion of the scroll compressor and a vibration damping unit is formed in a lower portion of the base plate. The vibration damping unit dampens vibration of the scroll compressor.

In operation, a low pressure refrigerant goes through an expansion process and enters the intake conduit. Part of the refrigerant is moved to the scroll compression portion, and the other part is moved to the lower portion of the compressor where it is stored in the oil reservoir. The high-pressure refrigerant compressed in the scroll compression portion is discharged through the discharge conduit.

During the compression process, oil and refrigerant in the reservoir are pumped upward by the oil pump. The oil goes up to the upper portion of the driving shaft along the oil feeding passageway and is absorbed in a friction portion of the scroll compression portion, to thereby serve as a lubricant.

During the compression process, the rotor spins at high speed and consequently serves as a vibration source. Another vibration source is also provided by the functional characteristics of the scroll compression portion. Vibrations from these and/or other sources are transmitted to the base plate through a case of the scroll compressor, and then are damped by the vibration damper.

The vibrations generated in the compressor include axial vibration forces and torsional vibration forces. Axial vibration forces vibrate the compressor in upward and downward directions and may be dampened by the dampening unit. However, in the aforementioned scroll compressor, the vibration damping unit cannot effectively dampen torsional vibration forces. In addition, the vibration damping unit is formed of a single member and therefore cannot effectively absorb excessive impact of the scroll compressor. As a result, failure from fatigue may occur in the vibration damping unit over prolonged use of the scroll compressor.

FIG. 1 shows a scroll compressor that includes another type of vibration damper. The scroll compressor 1 includes a casing 10 and a bottom plate 11 that conforms or otherwise defines an external shape of the compressor. The compressor further includes a driving portion formed in the casing for generating torque, an intake portion for drawing fluid from an external source, a scroll compression portion for compressing fluid from the intake portion, a discharge portion for discharging high-pressure gas compressed by the scroll compression portion, and an oil pump 50 for supplying oil to the scroll compression portion.

The compressor further has a vibration damper 40 for dampening vibration which, for example, may be generated by or within the compressor. In accordance with one embodiment, vibration damper 40 may be coupled to a bottom of a base plate 20 used to support a lower portion of the compressor.

The intake portion includes an intake conduit 95, formed in a portion of an outer periphery of the casing, and an intake chamber 96. The intake chamber is connected through the intake conduit, and drawn refrigerant is accumulated in the intake chamber.

The discharge portion includes a discharge port 92, a discharge chamber 93, and a discharge conduit 94. The discharge port may be formed in the middle of a fixed scroll 90 and operates to discharge compressed refrigerant. The discharge chamber is connected through the discharge port and is formed in a top portion of the casing. The discharge conduit may be formed in a side of the discharge chamber.

The driving portion includes a driving motor 60 and a driving shaft 53. The driving motor includes a stator 62 and a rotor 61 located in the stator. The driving shaft is inserted into a center of the driving motor to impart rotation thereto. Oil pumped by oil pump 50 flows upward through an oil feeding passageway 54 in driving shaft 53.

Rotor 61 rotates to deliver torque to the driving shaft. The torque is transmitted to the oil pump and scroll compression portion. Torsional vibration forces generated by the torque are then dampened by vibration damper 40 in a manner that will be discussed in greater detail below.

The oil pump includes an inner gear 51 and an outer gear 52. The inner and outer gears are inserted into an insert hole formed in a lower frame 64, and then a pump cover 65 is attached to the lower frame to cover the oil pump.

When the driving shaft rotates, the inner and outer gears also rotate. In addition, oil in the oil chamber is moved upward along oil feeding passageway 54 as a result of rotation of the inner and outer gears. The oil is absorbed between an orbiting scroll thrust bearing surface 82 and an upper frame thrust bearing surface 66 to thereby serve as a lubricant.

The scroll compression portion includes an upper frame 63, an orbiting scroll 80, a fixed scroll 90, a fixed scroll wrap 91, an orbiting scroll wrap 81, and the discharge port 92. An upper portion of driving shaft 53 is inserted into and supported by the upper frame. The orbiting scroll, supported by an upper portion of the upper frame, compresses refrigerant drawn through intake conduit 95. The fixed scroll meshes with the orbiting scroll and is fixed on the upper portion of upper frame 63 by a fixing means.

The fixed scroll wrap 91 may have a spiral shape and is formed on a bottom of fixed scroll 90. More specifically, the orbiting scroll wrap may be formed on a top of the orbiting scroll and may be out of phase with the fixed scroll wrap by a predetermined angular amount, e.g., 180 degrees. The discharge port 92 is formed in a center of the fixed scroll wrap.

Figure 2:
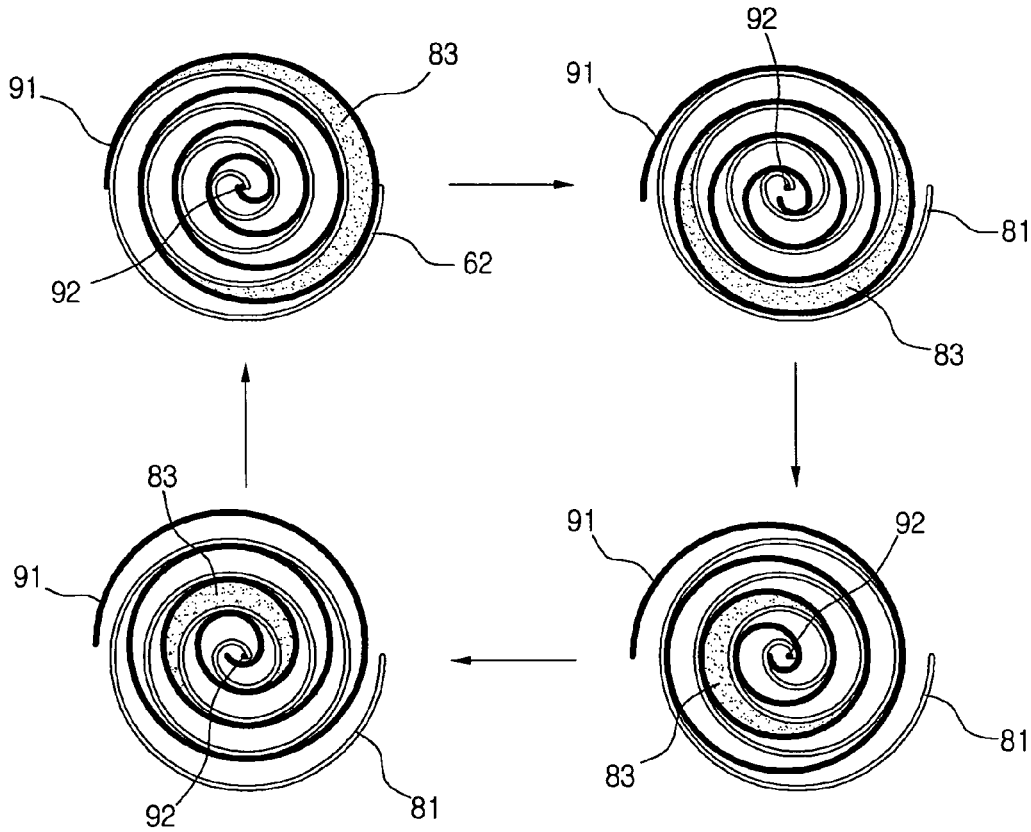
FIG. 2 is a diagram showing a refrigerant compression process that may be performed in the scroll compressor of FIG. 1.

FIG. 2 shows one type of refrigerant compression process that may be performed in the scroll compression portion of the scroll compressor of FIG. 1. According to this process, orbiting scroll 80 eccentrically orbits around driving shaft 53. In so doing, the orbiting scroll wrap 81 may follow the path set by the fixed scroll wrap 91 and is in contact with the fixed scroll wrap. Thus, a compartment or chamber 83 for compressing the refrigerant is formed. The compartment travels from an outside area and then pushes towards the center of the scroll wraps, all the while decreasing in volume to thereby apply increased pressure until the compressed refrigerant is discharged to discharge chamber 93 through discharge port 92.

Figure 3:
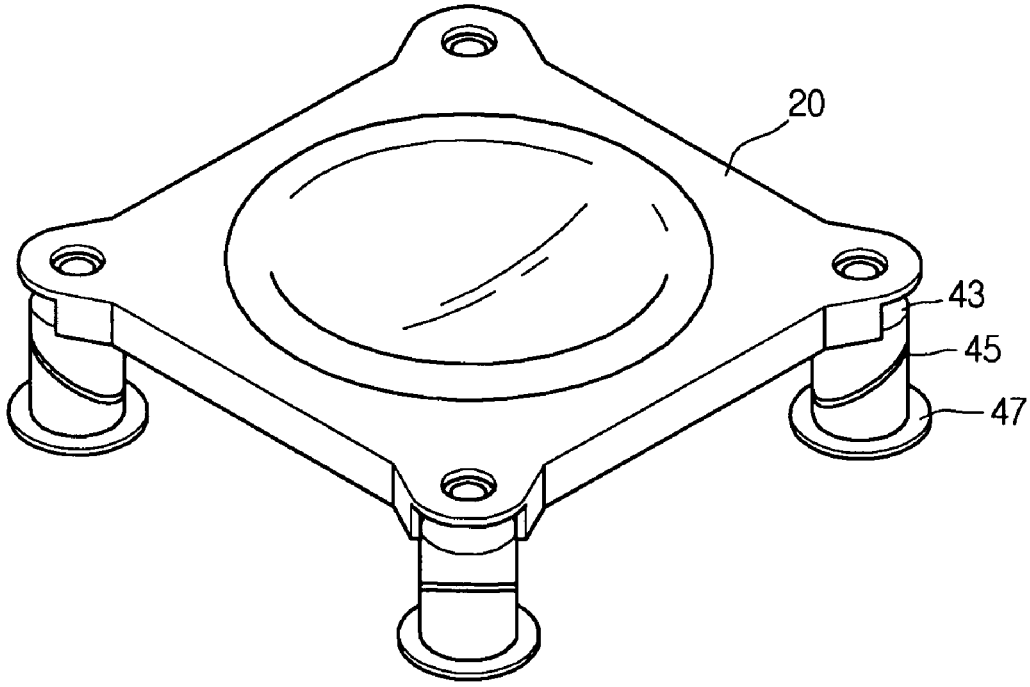
FIG. 3 is a diagram showing an exemplary coupling relationship between the vibration damper and a base plate of the scroll compressor of FIG. 1.

FIG. 3 shows an example of a coupling relationship that may exist between vibration dampers 40 and base plate 20 for the scroll compressor of FIG. 1. According to this relationship, the base plate supports the scroll compressor, for example, at the bottom plate. If desired, a plurality of vibration dampers 40 may be coupled to a bottom of the base plate by a coupling member 30. The vibration dampers may be disposed on at least four edge portions of the base plate to disperse a vibration of the scroll compressor. In alternative embodiments, a fewer number of vibration dampers 40 may be coupled to the bottom of the base plate in the same or different locations, e.g., other than at the corners of the base plate.

Figure 4:
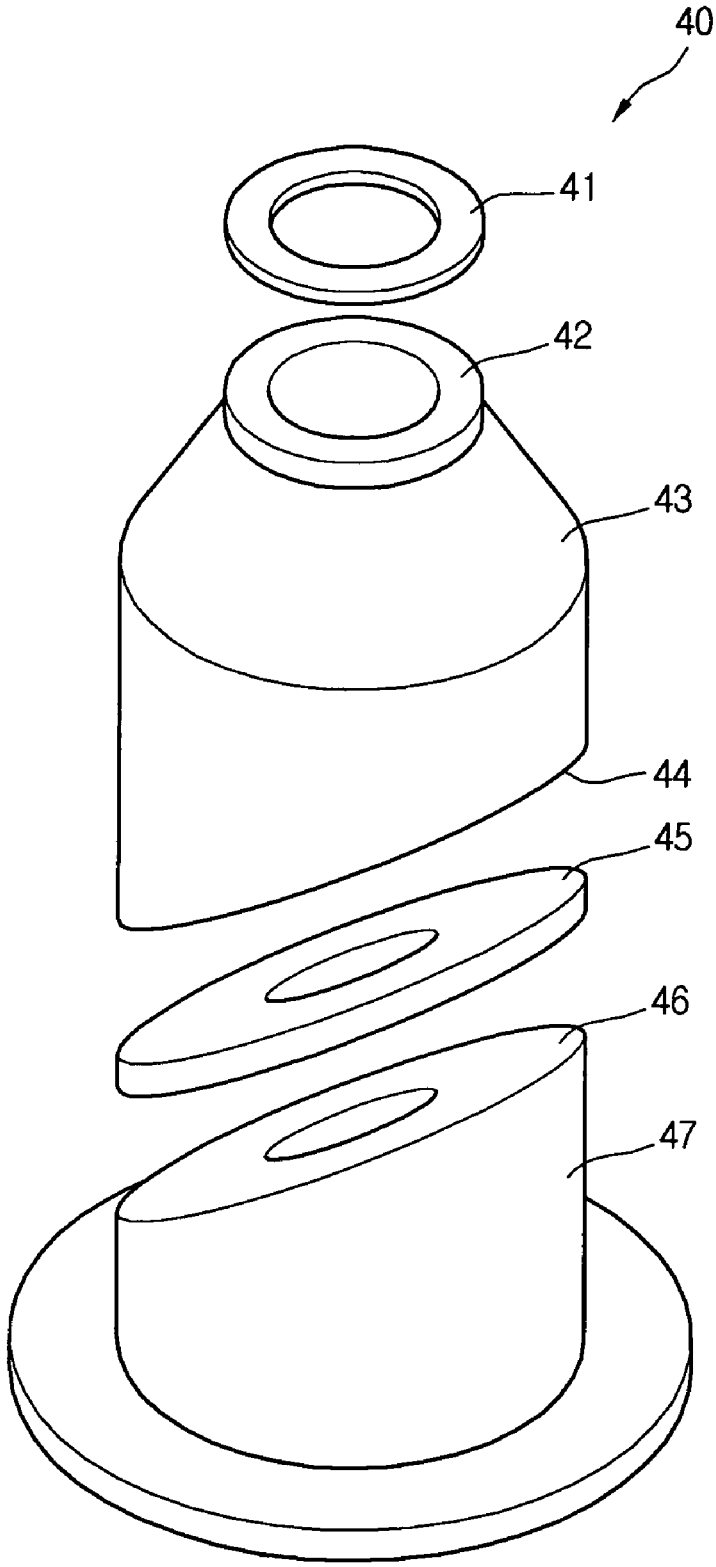
FIG. 4 is a diagram showing one type of vibration damper that may be included in the scroll compressor of FIG. 1.

FIG. 4 shows an exploded view of vibration damper 40. As shown, the vibration damper includes an upper damping member 43, a cover member 41, a dispersion member 45, and a lower damping member 47. The upper damping member absorbs vibration generated by the scroll compressor. The cover member is interposed between the upper damping member and base plate and serves to protect against vibration failure of the upper damping member. The dispersion member contacts a bottom 44 of the upper damping member to disperse vibrational forces generated from the scroll compressor. And, the lower damping member absorbs vibrations dispersed by the dispersion member.

More specifically, vibration damper 40 is coupled to base plate 20 and cover member 41 is interposed between upper damping member 43 and the base plate. Cover member 41 may be made of a material that is able to sufficiently withstand vibration and a load transmitted by the driving action taking place within the scroll compressor. This material may be a metal having a predetermined strength, a polymer, or another material. The cover member serves to improve contact characteristics between the upper damping member and base plate. In addition, the cover member protects against failure of the upper damping member.

In operation, load forces generated by or from the scroll compressor exert pressure on upper damping member 43. The upper damping member may be formed, for example, from rubber in order to effectively absorb vibration. Thus, when a load from the compressor exerts pressure on the upper damping member, a top portion of the upper damping member contacting the base plate is prevented from being damaged, thereby protecting the upper damping member from failure. That is, cover member 41 stabilizes interaction between upper damping member 41 and base plate 20.

The upper damping member may have a cylindrical shape. In this case, an inclined side wall may be formed from a predetermined position of the outer surface of the damping member towards a top surface 42. This inclined sidewall may have an ever-decreasing diameter and is set at a predetermined angle. The upper damping member 43 may also include a hole through which one coupling member 30 is inserted for securing the vibration damper to the base plate. The upper damping member may also have a bottom 44 having an inclined surface.

The lower damping member 47 may also have a cylindrical shape with a top 46 having an inclined surface. That is, bottom 44 of upper damping member 43 may be formed to have an inclined surface at a first predetermined angle, and top 46 of lower damping member 47 may be formed to have an inclined surface at a second predetermined angle. The first and second predetermined angles may be the same or different. If inclined surfaces 44 and 46 have at least substantially the same angle, they may be situated parallel to each other.

The lower damping member 47 may further include a through hole, through which coupling member 30 is inserted. The upper and lower damping members 43 and 47 may be formed of rubber or another material.

The dispersion member 45 has a size and shape that preferably corresponds to and contacts inclined surfaces 44 and 46. That is, the dispersion member may have inclined surfaces that correspond to inclined surfaces 44 and 46. The dispersion member may therefore have a uniform thickness, or in the case where inclined surfaces 44 and 46 are not parallel or are not formed at a same angle dispersion member 45 may have a non-uniform thickness. In addition, the dispersion member may have an elliptical shape or a circular shape.

When interposed between upper damping member 43 and lower damping member 47, the dispersion member is inclined at a predetermined angle. A normal line of the dispersion member may, for example, be inclined towards the center of the scroll compressor or along another line.

In addition, the dispersion member may include a hole through which coupling member 30 (e.g., a bolt 32) is inserted. A nut 31 may be coupled to the bolt to secure the arrangement. The dispersion member may be made of a metal member having a predetermined strength. When connected to the base plate of the compressor, dispersion member 45 divides vibration forces transmitted through upper damping member 43 into vertical and horizontal vibration components. These vibration components are effectively dampened by dispersion member 45 for dispersing vibration.

Figure 5:
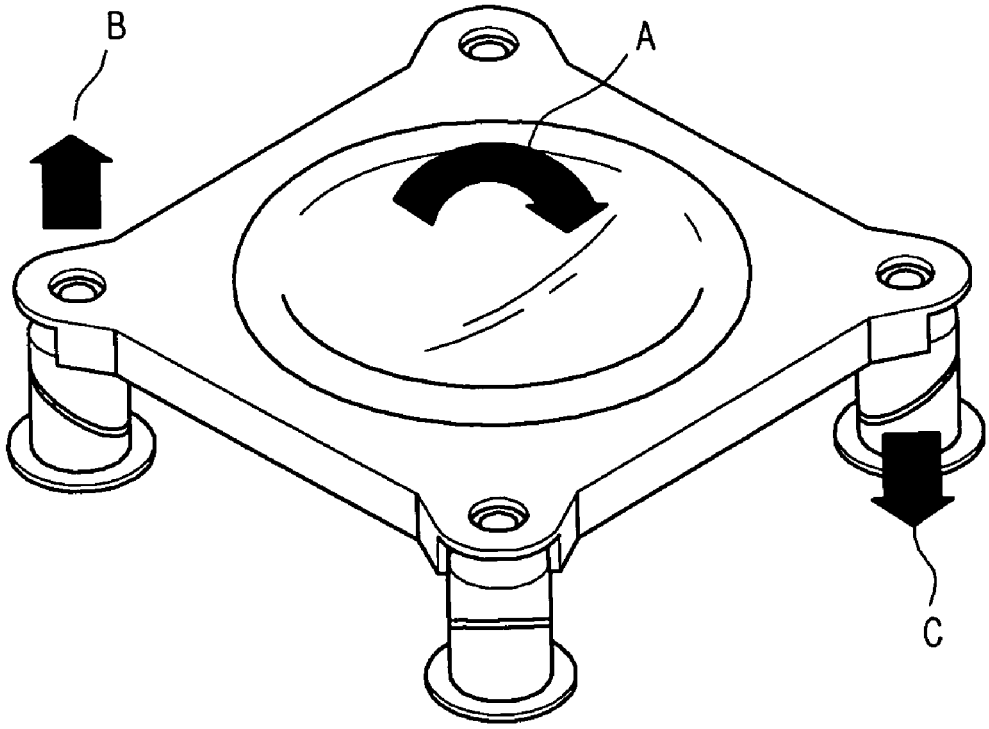
FIG. 5 is a diagram showing directions in which vibrational forces may be transmitted from the scroll compressor to the vibration damper of FIG. 4.
Figure 6:
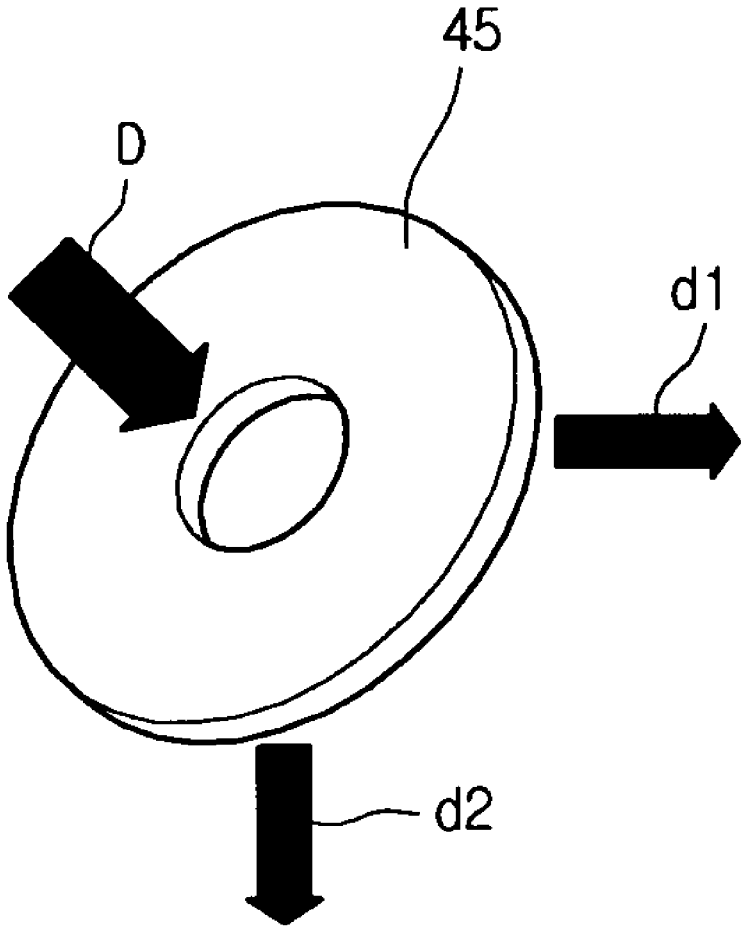
FIG. 6 is a diagram showing component vibrational forces that may be dispersed by a dispersion member included in the vibration damper of FIG. 1.

FIG. 5 shows directions in which the vibration forces may be transmitted by or from the scroll compressor to vibration damper 40, and FIG. 6 shows how the forces may be dispersed by dispersion member 45.

Referring to FIGS. 5 and 6, power applied to the driving portion rotates rotor 61 to generate torque. The torque is transmitted to orbiting scroll 80 through the driving shaft inserted into the rotor. Next, as the orbiting scroll orbits, orbiting scroll wrap 81 meshes with fixed scroll wrap 91. Fluid is then drawn through intake conduit 95. The fluid is drawn between the fixed scroll wrap and orbiting scroll wrap through an intake hole (not shown), which may be formed at a portion of fixed scroll 90. Next, the drawn fluid is pushed towards the center of scroll wraps 81 and 91 until the compressed fluid is discharged to discharge chamber 93 through discharge port 92. Finally, the compressed fluid in the discharge chamber is discharged through the discharge conduit 94.

Referring to FIG. 5, vibration forces generated from the compressor includes torsional vibration (A) and axial vibration (B and C). The axial vibration forces (B and C) persistently act on upper damping member 43. Cover member 41, interposed between base plate 20 and upper damping member 43, protects against fatigue failure of the upper damping member caused by the persistent vibration.

Further, referring to FIG. 6, the dispersion member divides a sum (D) of the torsional and axial vibration forces into vibration component d1 and vibration d2 component. The dispersion member, therefore, operates to greatly dampen both torsional and axial vibration forces generated by/from the scroll compressor.

Descriptions of scroll compressors and the operation thereof may be found, for example, in U.S. Pat. Nos. 6,695,600, 6,685,441, 6,659,735, and 6,287,099, the contents of which are incorporated herein by reference and which are subject to an obligation of assignment to the same entity.

Although the embodiments described herein relate to scroll compressors for ease of discussion, it is understood that a vibration damper as embodied and broadly described herein may be applied to other types of compressors and/or other applications which require fluid pumping. These other types of compressors include but are not limited to different types of scroll compressors, reciprocating compressors, centrifugal compressors, and vane-type compressors.

Figure 7:
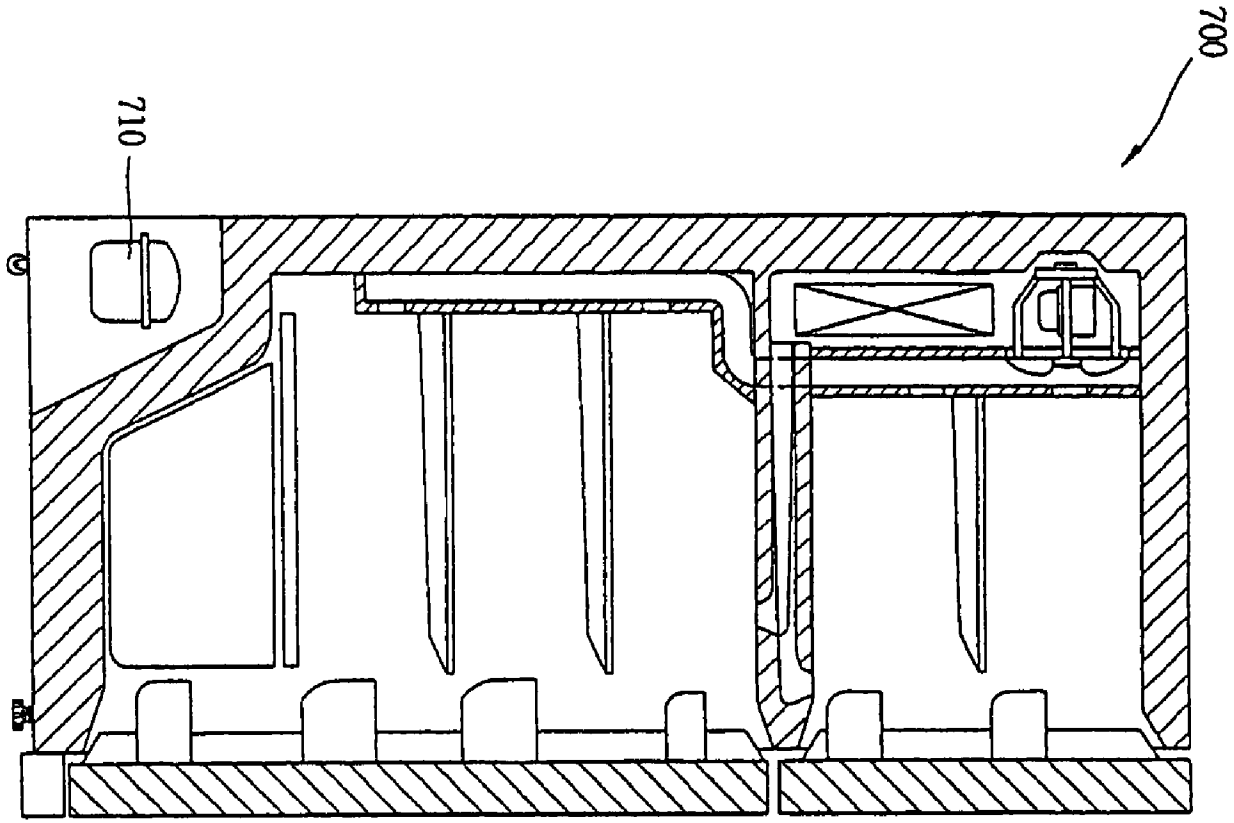
FIGS. 7, 8 and 9 are diagrams showing exemplary installations of a compressor which may include any of the embodiments of the vibration damper embodied and broadly described herein.

Moreover, a compressor containing the vibration damper described herein may have numerous applications in which compression of fluids is required. Such applications may include, for example, air conditioning or refrigeration applications. One such exemplary application is shown in FIG. 7, in which a compressor 710 having an oil pump as described herein is installed in a refrigerator/freezer 700. The installation and functionality of a compressor when embodied within a refrigerator is discussed in detail in U.S. Pat. Nos. 7,082,776, 6,955,064, 7,114,345, 7,055,338, and 6,772,601, the entirety of which are incorporated herein by reference.

Figure 8:
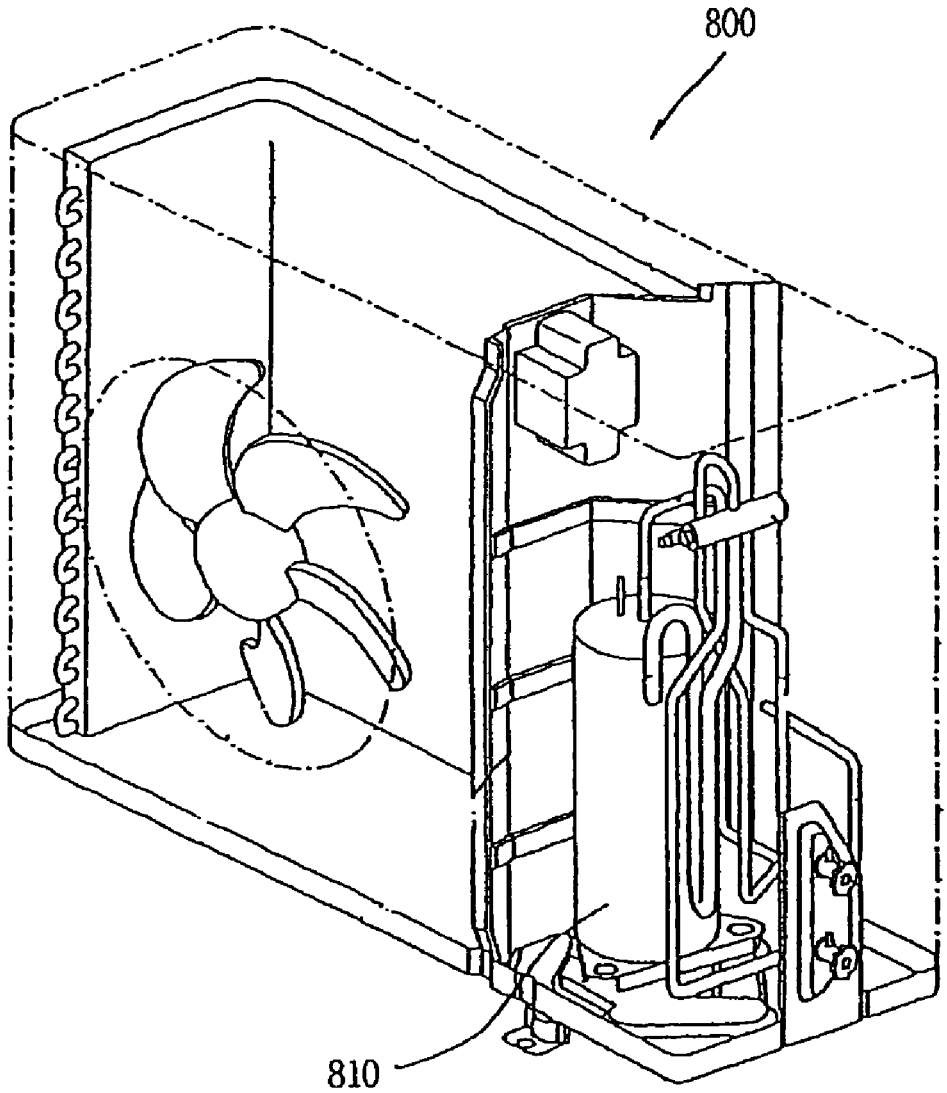

Another exemplary application is shown in FIG. 8, in which a compressor 810 having an oil pumping assembly as described herein is installed in an outdoor unit of an air conditioner 800. The installation and functionality of a compressor when embodied within an outdoor unit of air conditioner is discussed in detail in U.S. Pat. Nos. 7,121,106, 6,868,681, 5,775,120, 6,374,492, 6,962,058, 6,951,628, and 5,947,373, the entirety of which are incorporated herein by reference.

Figure 9:
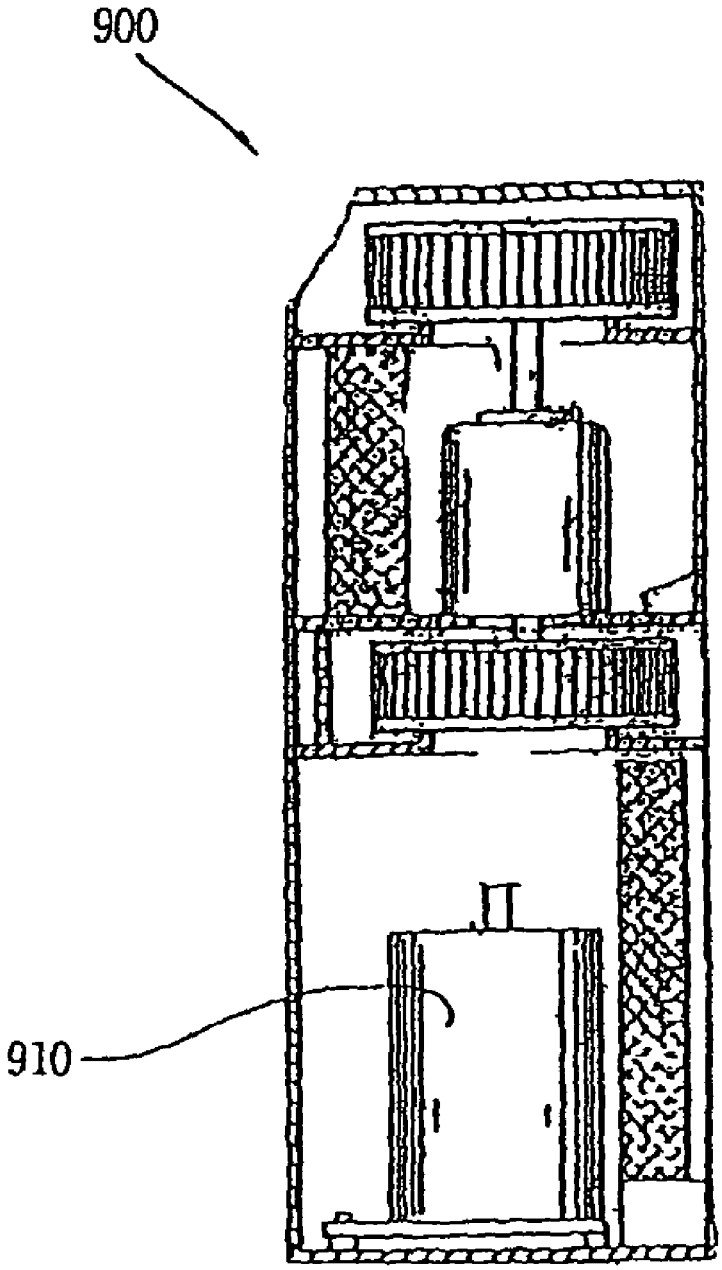

Another application of the compressor containing a vibration damper as described herein relates to an integrated air conditioning unit. As shown in FIG. 9, this application includes a compressor 910 having a vibration damper as described herein is installed in a single, integrated air conditioning unit 900. The installation and functionality of a compressor when embodied within an outdoor unit of air conditioner is discussed in detail in U.S. Pat. Nos. 7,036,331, 7,032,404, 6,588,228, 6,412,298, 6,182,460, and 5,775,123, the entirety of which are incorporated herein by reference.

Accordingly, one or more of the aforementioned embodiments are directed to an improved vibration damper for a compressor. In accordance with one embodiment, the vibration damper may effectively dampen vibration by dispersing vibration produced in a scroll compressor when operation of the scroll compressor is initiated. The vibration damper may also be capable of absorbing excessive vibration transmitted by a scroll compressor, thereby serving as an improved and resilient structure for preventing fatigue failure.

In accordance with one embodiment, the compressor vibration damper includes an upper damping member supporting a base plate formed on a bottom of a compressor and damping vibration transmitted from the compressor, a lower damping member formed under the upper damping member, and a dispersion member interposed between the upper damping member and the lower damping member, the dispersing member dispersing the vibration from the compressor.

In accordance with another embodiment, the compressor vibration damper includes a vibration damping unit supporting a base plate formed on a bottom of a compressor and damping a vibration transmitted from the compressor, and at least one dispersion member dispersing the vibration, wherein the vibration damping unit includes at least two damping members, and the dispersion member is interposed between the damping members.

In accordance with another embodiment, the compressor vibration damper includes a plurality of vibration damping units vertically arranged so as to support a bottom of a compressor and damp a vibration transmitted from the compressor, and a dispersion member formed between the damping members, and dispersing the vibration, wherein the vibration damping units comprise inclined surfaces, respectively, and the dispersion member comprises an inclined surfaces corresponding to the inclined surfaces of the vibration damping units, respectively.

According to another embodiment, a plurality of damping members are provided in a compressor, where each damping member has improved strength which may serve to increase a maximum load that the vibration damper can stand.

In addition, since a dispersion member formed may be between the damping members to disperse vibration, vibration of the compressor may be effectively damped compared to other structures. Also, since a cover member may be formed between the vibration damper and base plate, an upper surface of the vibration damper is safe from fatigue failure.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vibration dampener, comprising:

a first damping member coupled to a compressor;

a second damping member coupled to the first damping member; and a dispersion member, between the first and second damping members, to disperse at least torsional vibration forces from the compressor, wherein the first damping member is located under the compressor, said vibration dampener further comprising:

a single coupling member to couple the first damping member to the dispersion member, the single coupling member passing through the first damping member and the dispersion member, wherein:

the first damping member has a circumferential surface that is curved, the second damping member has a circumferential surface that is curved, the dispersion member has a circumferential surface that is curved, the circumferential surfaces of the first damping member, the second damping member, and the dispersion member have substantially a same curvature, and the circumferential surfaces of the first damping member, the second damping member, and the dispersion member are aligned to form a continuous outer surface from a top portion of the first damping member to a bottom portion of the second damping member.

2. The vibration dampener of claim 1, wherein the dispersion member has substantially a shape of a disk.

3. The vibration dampener of claim 2, wherein the dispersion member has a substantially elliptical cross-section.

4. The vibration dampener of claim 3, wherein a bottom surface of one of the first or second damping members is slanted to have a substantially elliptical shape and a top surface of the other of the first or second damping members is slanted to have a substantially elliptical shape, and wherein the elliptical shape of the dispersion member conforms to the slated surfaces of the first and second damping members, said top and bottom surfaces contacting respective surfaces of the dispersion member to form said continuous outer surface.

* * * * *